US006525455B1

(12) United States Patent
Matsuba et al.

(10) Patent No.: US 6,525,455 B1
(45) Date of Patent: Feb. 25, 2003

(54) BULB-FORM LAMP AND ITS MANUFACTURING METHOD

(75) Inventors: Tetsuo Matsuba, Neyagawa (JP); Shinichiro Ishitsuka, Osaka (JP); Takenori Shibata, Takatsuki (JP); Takeshi Matsumura, Kashiwara (JP)

(73) Assignee: Matsushita Electric Industrial Co., Ltd. (JP)

( * ) Notice: Subject to any disclaimer, the term of this patent is extended or adjusted under 35 U.S.C. 154(b) by 104 days.

(21) Appl. No.: 09/656,764

(22) Filed: Sep. 7, 2000

(30) Foreign Application Priority Data

Sep. 22, 1999 (JP) ..... 11-268633
Jul. 7, 2000 (JP) ..... 2000-206493

(51) Int. Cl.[7] ..... H01J 5/48; H01J 1/18
(52) U.S. Cl. ..... 313/318.04; 313/312; 439/615
(58) Field of Search ..... 313/318.04, 318.03, 313/318.01, 317, 312; 439/611, 612, 613, 614, 615; 220/2.1 R, 2.2

(56) References Cited

U.S. PATENT DOCUMENTS

| | | | | | |
|---|---|---|---|---|---|
| 1,656,793 | A | * | 1/1928 | Kayte | 315/68 |
| 1,948,386 | A | * | 2/1934 | Leveile | 176/31 |
| 2,336,529 | A | * | 12/1943 | Cartun | 176/32 |
| 2,799,794 | A | * | 7/1957 | Dickson | 313/318 |
| 3,315,216 | A | * | 4/1967 | Krupp | 339/145 |
| 3,885,186 | A | * | 5/1975 | Vause | 313/318 |
| 4,392,076 | A | * | 7/1983 | Ishler et al. | 313/318 |
| 5,032,759 | A | * | 7/1991 | Thiry et al. | 313/318 |

* cited by examiner

*Primary Examiner*—Nimeshkumar D. Patel
*Assistant Examiner*—Thelma Sheree Clove
(74) *Attorney, Agent, or Firm*—Parkhurst & Wendel, L.L.P.

(57) ABSTRACT

To provide a bulb-form lamp including a few compartments, which can be easily fitted in a socket of a lighting equipment and reliably carry out electrical contact between a shell and the socket of the lighting equipment. The bulb-form lamp includes a shell surrounding one end of a casing, and the shell is molded integrally with one end of the casing to make contact with an outer surface of the casing leaving substantially no gap.

9 Claims, 11 Drawing Sheets

BULB-FORM LAMP AND ITS MANUFACTURING METHOD

FIELD OF THE INVENTION

The present invention relates to a bulb-form lamp and its manufacturing method.

BACKGROUND OF THE INVENTION

A conventional bulb-form lamp, for example, a compact self-ballasted fluorescent lamp accommodates a light generating tube 4 and a lighting circuit 5 for lighting the light generating tube 4, in an envelope 29 including a globe 1 and a casing 28, as shown in FIG. 12.

In one end of the casing 28, a cap 30 is inserted and caulked to be fixed. The cap 30 has a screw-shaped shell 31 screw and an eyelet 33 provided at one end of the shell 31 via a glass insulting part 32. The shell 31, the insulting part 32 and the eyelet 33 are integrally formed by embedding each part of the shell 31 and the eyelet 33 in the insulating part 32.

Japanese Patent Laid-Open No. 9-97589 specification discloses another compact self-ballasted fluorescent lamp including a holder member (a casing) provided with a screw cap on an outer periphery of a cylindrical part formed at its one end. The screw cap is provided with a longitudinally formed recess, in which a feeding terminal forming a strip-shaped side terminal is provided.

However, such a conventional bulb-form lamp, for example, the compact self-ballasted fluorescent lamp shown in FIG. 12, has a problem that the casing 28 and the cap 30 are separately manufactured and then assembled together, resulting in many steps in process and low productivity efficiency.

In addition, a socket of a lighting equipment wherein the conventional compact self-ballasted fluorescent lamp is fitted, has been increasingly provided with a strip-shaped lamp holder for contact with the shell 31 or the feeding terminal.

In case where the compact self-ballasted fluorescent lamp disclosed in Japanese Patent Laid-Open No. 9-97589 specification is fitted in such a socket with the strip-shaped lamp holder, there is a problem that the strip-shaped lamp holder and the strip-shaped feeding terminal readily catch against each other, failing in fitting of the lamp in the socket. Another problem is that the lamp holder and the feeding terminal do not attain right positioning for contact therebetween, failing in lighting.

The present invention is achieved for solving such problems to provide a bulb-form lamp, including a few components and manufactured at low cost, which can be easily fitted in a socket of a lighting equipment and ensure electrical contact between the shell and the socket of the lighting equipment.

The present invention also provides a bulb-form lamp manufacturing method which enables reduction in the number of steps and improvement in productivity.

SUMMARY OF THE INVENTION

A bulb-form lamp according to the present invention has a configuration including a shell surrounding one end of a casing, the shell being molded integrally with one end of the casing to make contact with an outer surface of the casing leaving substantially no gap.

By such a configuration as including a few components and being able to be manufactured at a low cost, for example, when the shell is fitted in a socket of a lighting equipment having a strip-shaped lamp holder, the shell does not catch against the lamp holder so that it can be easily fitted in the socket and that the shell can make electrical contact with the lamp holder wherever the lamp holder is.

A bulb-form lamp manufacturing method according to the present invention uses a method for molding the shell integrally with one end of the casing leaving substantially no gap at the same time as molding the casing by using a die assembly.

Such integral molding of the shell with the casing when the casing is being molded eliminates the need for each conventional manufacturing step of the casing and the cap, and a step for assembling thereof, resulting in reduction in the number of steps.

DESCRIPTION OF THE EMBODIMENTS

Embodiments of the present invention will be described below with reference to the drawings.

Figure 1:
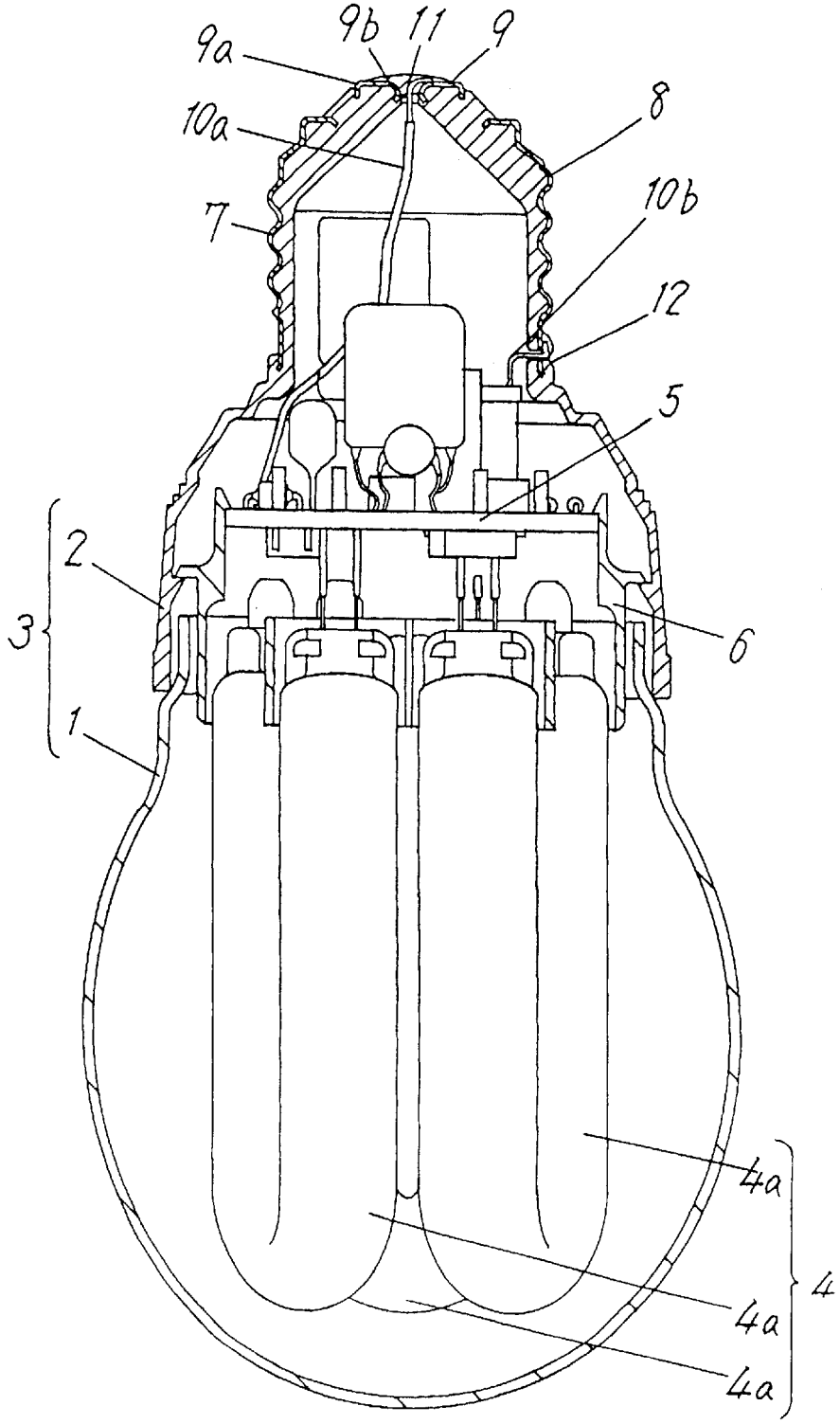
FIG. 1 is a partly fragmentary front view of a compact self-ballasted fluorescent lamp according to a first embodiment of the present invention.

A compact self-ballasted fluorescent lamp with rated power of 13W according to a first embodiment of the present invention has overall length of 120 mm and maximum outer diameter of 60 mm. As shown in FIG. 1, an envelope 3 including a translucent globe 1 and a resinous casing 2 accommodates a fluorescent tube 4, in which three U-shaped tubes 4*a* with outer diameter of 11 mm are bridge jointed to form a single discharge passage, a lighting circuit 5 for lighting the fluorescent tube 4, and a holder 6 holding the lighting circuit 5 at a side opposite from the fluorescent tube 4.

At one end of the casing 2, a cap 7 is formed which is to be fitted in a socket of a lighting equipment (not shown), having a length of 27 mm and the maximum outer diameter of 26.4 mm.

The cap 7 includes a shell 8 formed with screw threads at its side, an eyelet 9, and part of the casing 2 insulating the shell 8 and the eyelet 9.

The shell 8 and the eyelet 9 are made of copper, brass, iron, stainless, nickel or the like, and their surfaces are coated with tin, zinc, nickel or the like for rustproofing.

The shell 8 surrounds one end of the casing 2, and is molded integrally with a side surface of one end of the casing 2 to make contact with an outer surface of the casing 2 leaving no gap. Accordingly, the outer surface of one end of the casing 2 is formed with screw threads along an inner surface of the shell 8. The shell 8 is described above to be in contact with the outer surface of the casing 21 leaving no gap, when molded. However, because of the difference in thermal expansion coefficient between the shell 8 and the casing 2, there are actually such cases that a very small gap (about 0.1 to 0.3 mm) appears partly (not all along) between the shell 8 and the casing 2 due to thermal contractions of the shell 8 and the casing 2 during the integral molding. In view of this fact, the shell 8 integrally molded with a side surface of one end of the casing 2 will hereinafter be expressed as to be in contact with the outer surface of the casing 21 "leaving substantially no gap."

Further, the shell 8 is embedded at its both ends in the casing 2. This permits tight fixing of the shell 8 to the casing 2, thereby preventing the shell 8 from being twisted off the casing 2. In this case, the above described effect can be obtained when at least one end of the shell 8 is embedded in the casing 2.

In addition, each tip of both ends of the shell 8 is bent inwardly and outwardly from the shell 8, respectively. This permits further tight fixing of the shell 8 to the casing 2, thereby preventing the shell 8 from being off the casing 2. In this case, the above described effect can be obtained when the tip of at least one end of the shell 8 embedded in the casing 2 is bent inwardly or outwardly from the shell 8.

Figure 3:
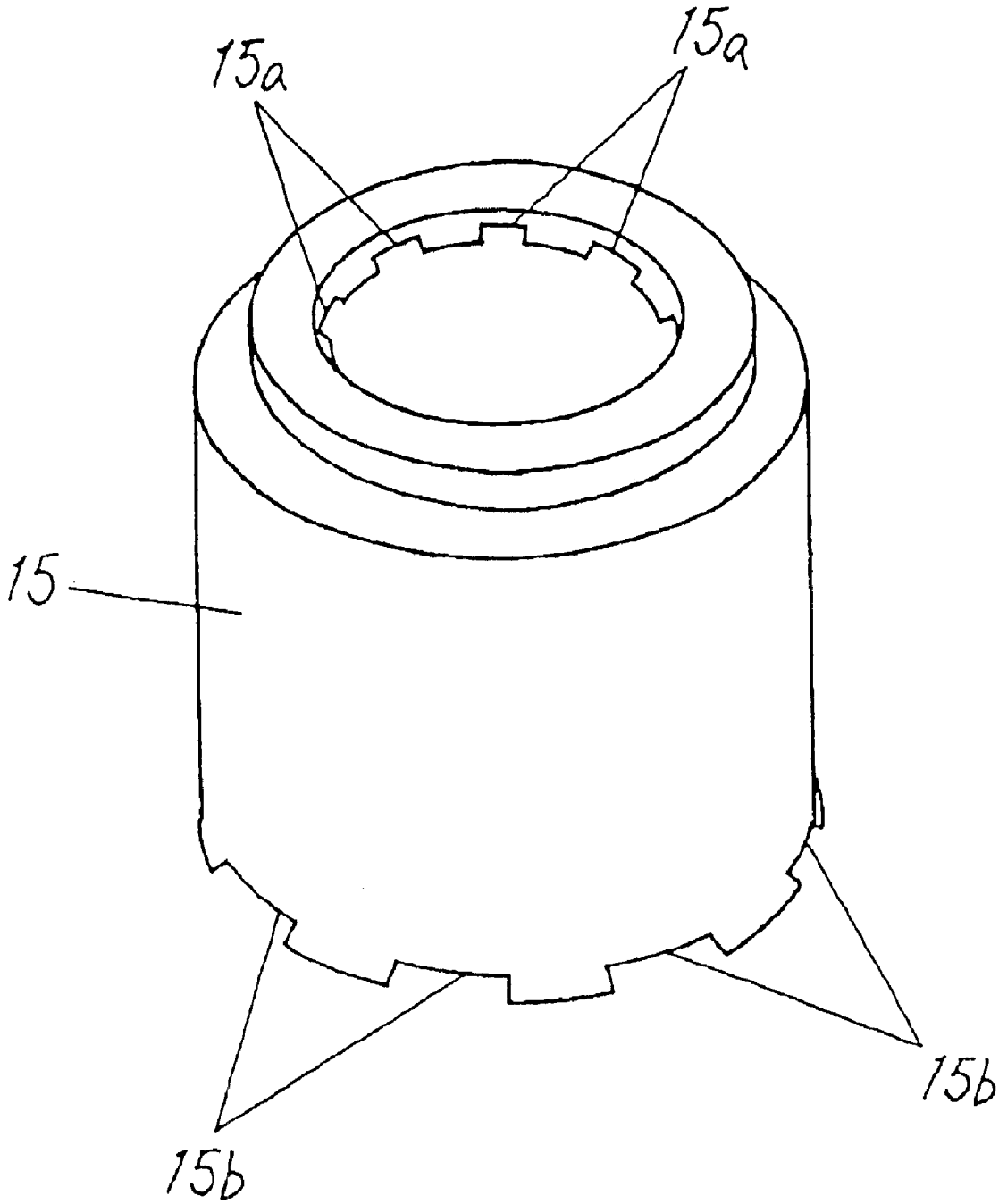
FIG. 3 is a perspective view of a shell member for forming a shell of the compact self-ballasted fluorescent lamp.

Furthermore, at the tips of both ends of the shell 8 embedded in the casing 2, a plurality of below-mentioned cut-out portions 15*a*, 15*b* are provided as shown in FIG. 3. This improves rotational strength of the shell 8 when the cap 7 is fitted in or removed from the socket of the lighting equipment, thereby preventing lost motion of the shell 8. In this case, the above described effect can be obtained when the cut-out portion 15*a* (15*b*) is provided at the tip of at least one end of the shell 8 embedded in the casing 2.

The eyelet 9 is formed from disk plate with thickness of 0.1 to 0.2 mm and molded integrally with one end of the casing 2 to make contact with the outer surface of the casing 2 leaving substantially no gap. In addition, a circumferential portion 9*a* of the eyelet 9 fitted in a periphery 9*b* of a below-mentioned through hole 11 is bent toward the casing 2 and embedded therein. This permits preventing the eyelet 9 from being off the casing 2.

Electrodes (not shown) are provided at both ends of the fluorescent tube 4, which is filled with predetermined amount of mercury and rare gas.

Two lead wires 10*a* and 10*b*, outer diameter of each conductor of 0.5 mm, are connected to the lighting circuit 5 for supplying electric power. One of the lead wires 10*a* is lead through the through hole 11, provided by penetrating the eyelet 9 at its center together with the casing 2, and connected to the outer surface of the eyelet 9 by soldering. The other lead wire 10*b* is lead through another through hole 12, provided by penetrating the shell 8 at its end opposite from the eyelet 9 together with the casing 2, and connected to the outer surface of the shell 8 by soldering.

Figure 2:
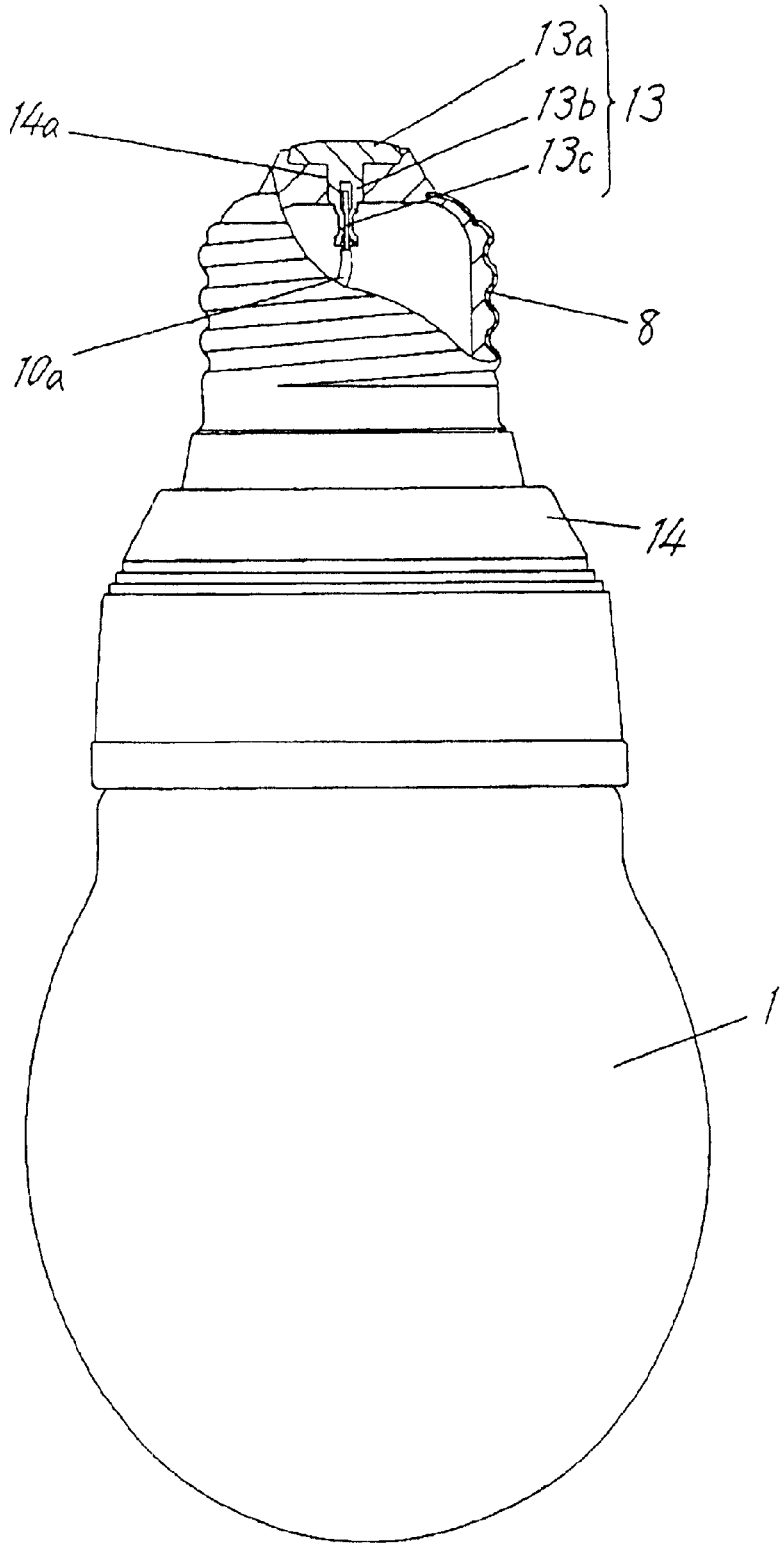
FIG. 2 is a partly fragmentary front view of a compact self-ballsted fluorescent lamp using another eyelet.

In the above description, the eyelet 9 is used which is formed from a disk plate, part thereof being embedded in the casing 2, as shown in FIG. 1; alternatively, an eyelet 13 may be used as shown in FIG. 2.

The eyelet 13 is in the shape of a push-pin including a head 13*a* and a pin 13*b*. Provided at a tip of the pin 13*b* is a lead wire inserting portion 13*c* connected to a lead wire 10*a*. The eyelet 13 is made from the same material as the eyelet 9.

In case of using the eyelet 13, the structure of a tip of one end of the casing 14 is as shown in FIG. 2. The casing 14 is provided, at the tip of its one end, with an eyelet receptacle 14*a*, inside of which has the same shape as outside of the eyelet 13. The eyelet 13 is fitted to the eyelet receptacle 14*a*.

Next, in the above described compact self-ballasted fluorescent lamp, a manufacturing method of the casing 14 will be described particularly in case of using the eyelet 13 shown in FIG. 2.

As shown in FIG. 3, a blank member for forming the shell 8 (hereinafter referred to a shell member 15) has a cylindrical shape with overall length of 23 mm, maximum outer diameter of 24 mm and thickness of 0.1 to 0.2 mm. Each of both ends of the shell member 15 is previously bent inwardly (see the upper side in FIG. 3) and outwardly (see the lower side in FIG. 3) from the shell member 15, respectively. Besides, at the tips of both ends of the shell member 15, a plurality of cut-out portions 15*a* and 15*b* are provided.

The casing 14 is molded by means of pouring liquid resin into below-mentioned dies.

Figure 4:
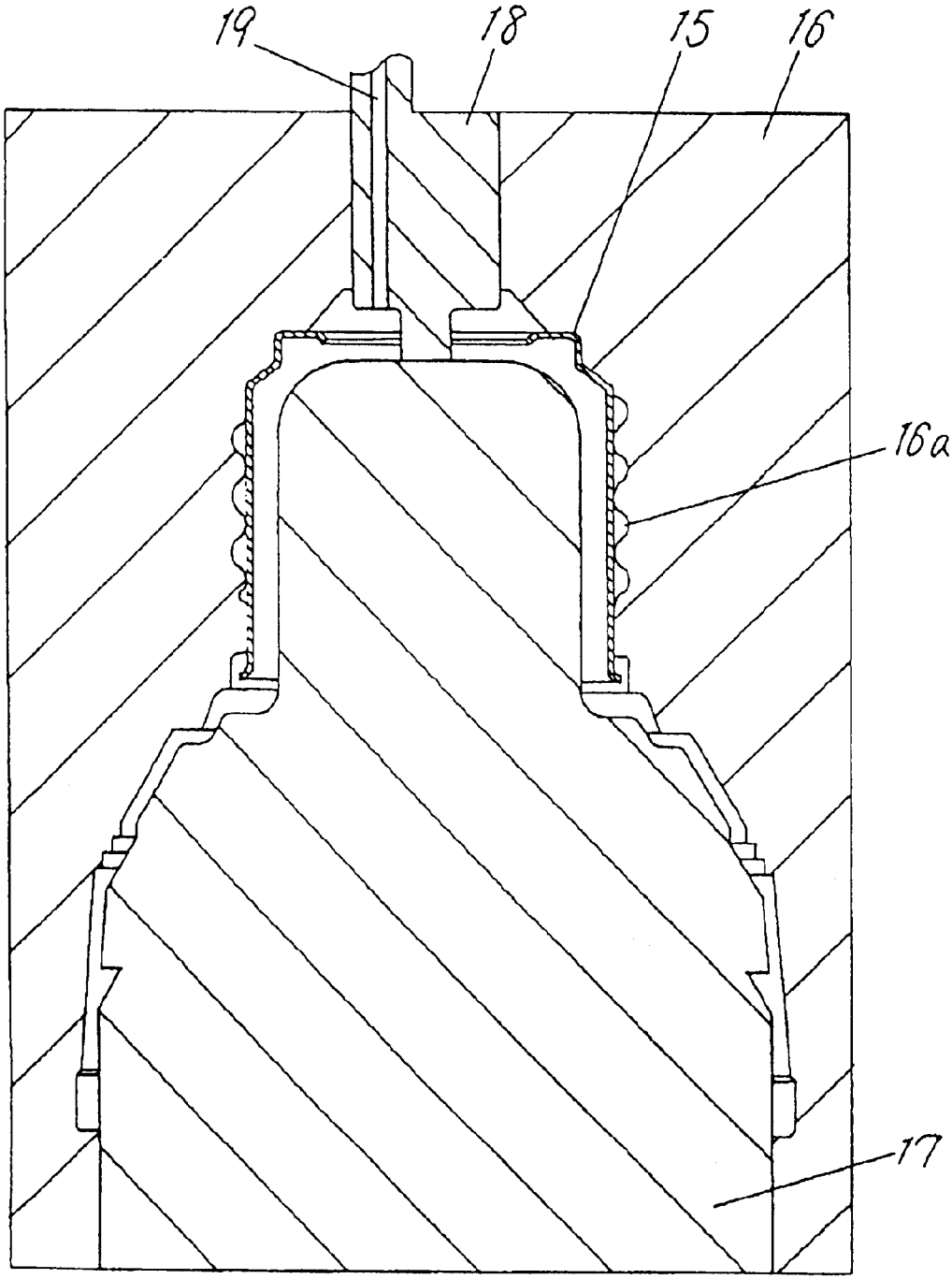
FIG. 4 is a view showing a method of manufacturing a casing used for the compact self-ballasted fluorescent lamp.

As shown in FIG. 4, a first die 16 is arranged so as to surround the shell member 15. The first die 16 is used for molding an outer shape of the casing 14 except the eyelet receptacle 14*a* shown in FIG. 2. In addition, the first die 16 is provided, at a portion in contact with the shell 15, with screw-shaped grooves 16*a* for molding screw threads on an outer surface of the shell member 15.

A second die 17 is arranged at its part in the shell member 15 to mold an inner shape of the casing 14.

A third 18 is arranged at a top of a portion where one end of the casing 14 is to be formed, in order to mold the eyelet receptacle 14*a*. The third die 18 is provided with a resin inlet 19 for pouring liquid resin 20 (not shown in FIG. 4), which is material for the casing 14 such as polybutylene terephthalate, into a space formed by the first to the third dies 16 to 18.

Figure 5:
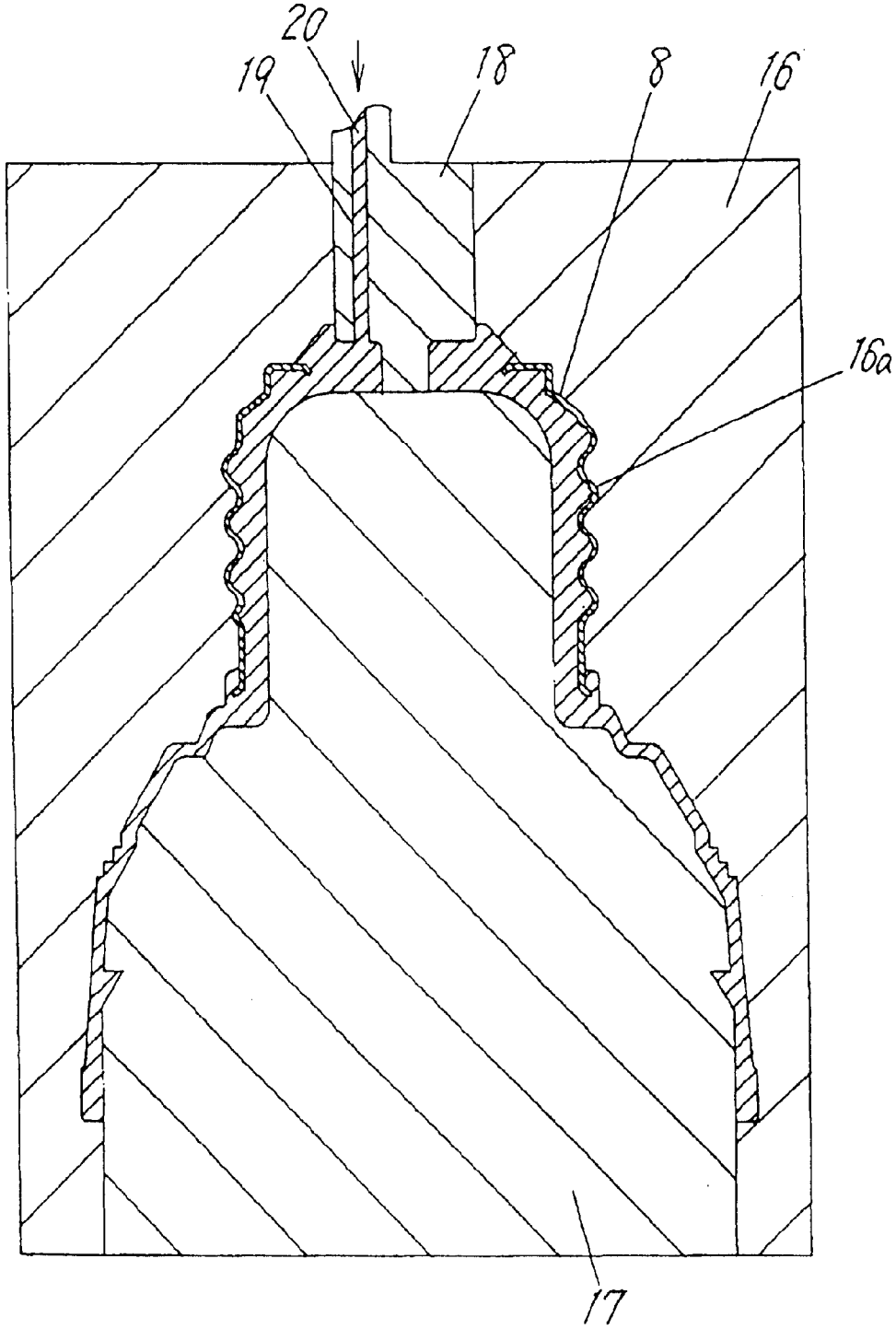
FIG. 5 is a view showing a method of manufacturing a casing used for the compact self-ballasted fluorescent lamp.

Subsequently, as shown in FIG. 5, the liquid resin 20 is poured from the resin inlet 19 into the space formed by the first to the third dies 16 to 18 to thereby fill the space. When pouring the liquid resin 20, predetermined pressure is applied to the poured liquid resin 20. By this pressure, part of the shell member 15 is expandingly forced into the screw-shaped grooves 16*a* of the first die 16 to be molded in the shape of the screw-shaped grooves 16*a*. Thus, the shell member 15 is molded to be the shell 8 in the shape of a screw.

Figure 6:
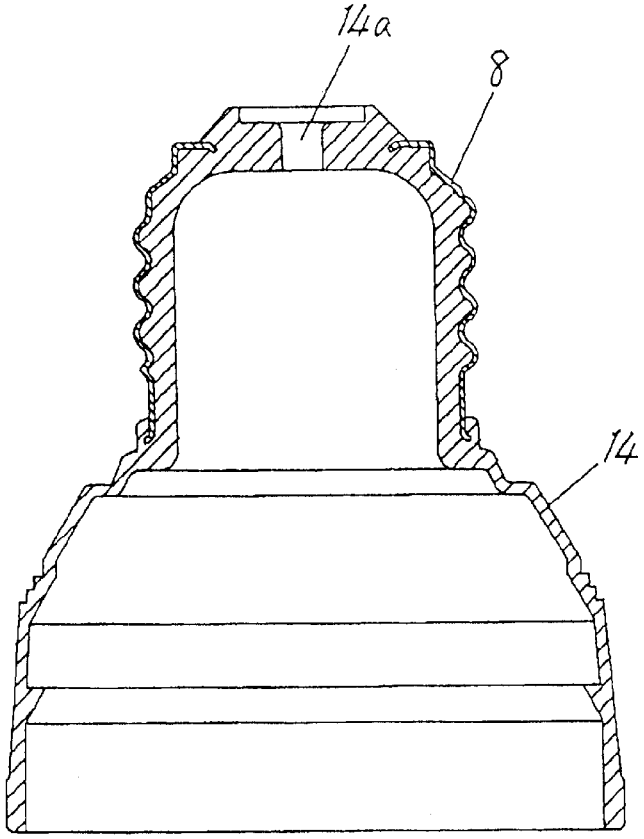
FIG. 6 is an enlarged sectional view of a casing used for the compact self-ballasted fluorescent lamp.

Then, by caking the poured liquid resin 20 and thereafter removing the dies 16, 17 and 18, the casing 14 is manufactured, as shown in FIG. 6, which is integrally molded at its one end with the shell 8 formed with the screw threads at its side surface.

The both ends of the shell 8 including the bent portions and the cut-out portions 15*a* and 15*b* are arranged in the space formed by the first to the third dies 16 to 18, and thereby embedded in the casing 14 after caking of the resin 20.

In the above described first embodiment, description is made with respect to the manufacturing method of the casing 14 by using the eyelet 13 in the shape of a push-pin, as shown in FIG. 2. In the case of the eyelet 9, by changing the shape of the third die 18, the casing 2 shown in FIG. 1 can be manufactured by the same manufacturing method as described above.

Figure 7:
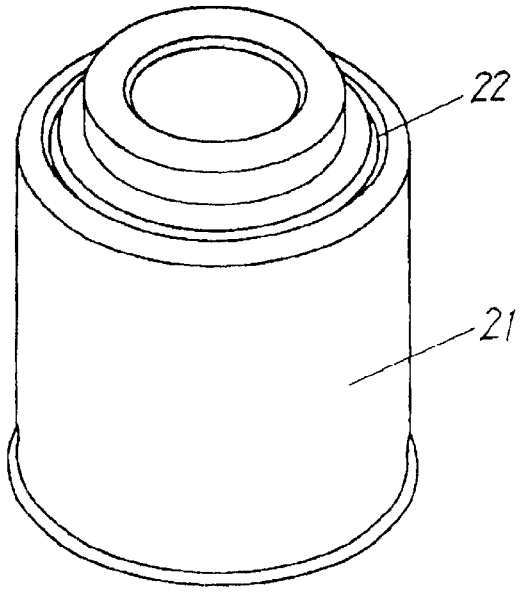
FIG. 7 is a sectional view of another shell member for forming the shell of the compact self-ballasted fluorescent lamp.

It is preferable that a shell member 21 shown in FIG. 7 is used as a blank member for forming the shell 8. The shell member 21 has a cylindrical shape, with overall length of 23 mm, maximum outer diameter of 24 mm and thickness of 0.1 to 0.2 mm. Each of both ends of the shell member 21 is bent inwardly (see the upper side in FIG. 7) and outwardly (see the lower side in FIG. 7) from the shell member 21, respectively. Besides, provided at an end of the shell member 21 is a circumferential groove 22 with width of 1.0 mm and depth of 0.5 mm.

The reason for preferably using the shell member 21 will be mentioned below.

Figure 8:
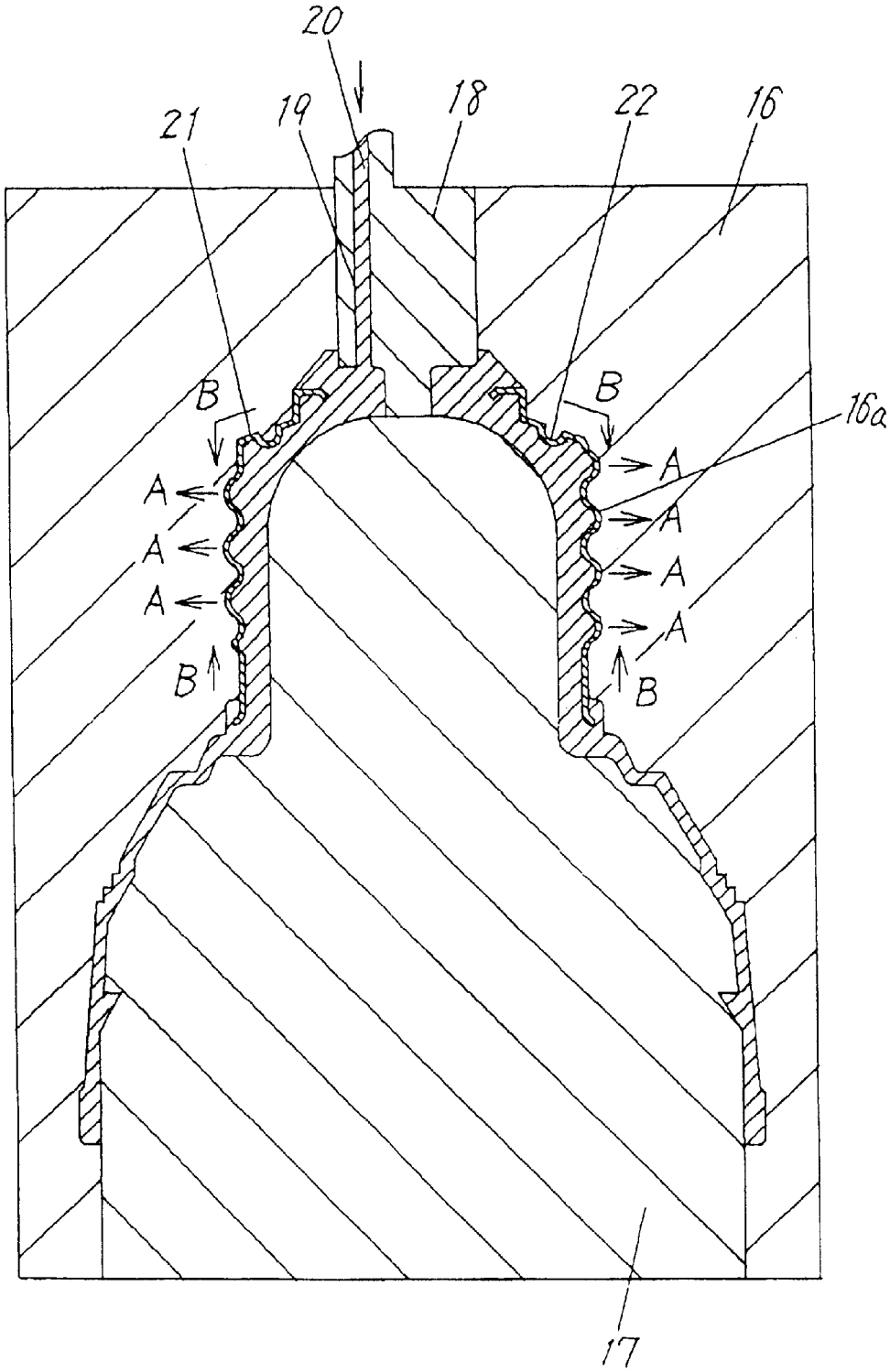
FIG. 8 is a view showing a method of manufacturing a casing at the time of using another shell member, in the compact self-ballasted fluorescent lamp.

As shown in FIG. 8, in case of pouring the liquid resin 20 into the space formed by the dies in order to die the casing 14, when dieing the screw threads on a side surface of the shell member 21 by applying pressure to the liquid resin 20, the portion of the shell member 21 where the screw threads are to be molded is pressed in A direction in FIG. 8, thereby a periphery of the portion is stretched in B direction in FIG. 8. The periphery, however, is stretched little in the B direction. As a result, the portion of the shell member 21 where the screw threads are to be molded is stressed, which causes crack in the screw threads of the shell member 21.

In this case, by using the shell member 21 provided at its end with the circumferential groove 22, even if the periphery of the portion of the shell member 21 where the screw thread is to be molded is stretched in the B direction, an opening of the groove 22 spreads, which enables absorbing stress occurring in the portion, resulting in preventing the screw threads of the shell member 21 from being cracked.

Like the shell member 15, the shell member 21 may be provided at its tips of both ends with a plurality of cut-out portions 15*a* and 15*b*.

As described above, the shell 8 is molded integrally with one end of the casing 2 or 14 to make contact with the outer surface of the casing 2 or 14 leaving substantially no gap. According to this configuration including a few components and manufactured at low cost, for example, when fitted in the socket of the lighting equipment having a strip-shaped lamp holder, the shell 8 does not catch against the lamp holder so that it can be easily fitted in the socket and that the shell 8 can make contact with the lamp holder wherever it is in the socket, which means that certain electrical contact can be obtained between the shell 8 and the socket.

By using the manufacturing method for molding the casing 2 or 14 by the dies at the same time as molding the shell 8 integrally with one end of the casing 2 or 14 leaving substantially no gap, the shell 8 is molded integrally with the casing 2 or 14 at the same time as molding of the casing 2 or 14, thereby eliminating the need for each conventional manufacturing step of the casing and the cap, and a step for assembling thereof, thereby reducing the number of steps, resulting in further improvement in production efficiency.

Particularly, by applying pressure on the material of the casing 2 or 14 poured into the space formed by the first to the third dies 16 to 18 at the same time as molding the casing 2 or 14, the screw threads are formed on the side surface of the blank member for forming the shell 8, thereby eliminating the need for a conventional separate step of forming the screw threads on the shell, resulting in further improvement in production efficiency.

In addition, particularly in case of using the eyelet 9 shown in FIG. 1, by using the above described method of molding the shell 8 integrally with the casing 2 or 14 at the same time as molding the casing 2 or 14, the eyelet 9 is molded integrally with the tip of one end of the casing 2 leaving no gap, thereby omitting a step of fitting the eyelet 13 to the eyelet receptacle 14*a* in comparison with the case of using the eyelet 13 shown in FIG. 2, resulting in further improvement in production efficiency.

Figure 9:
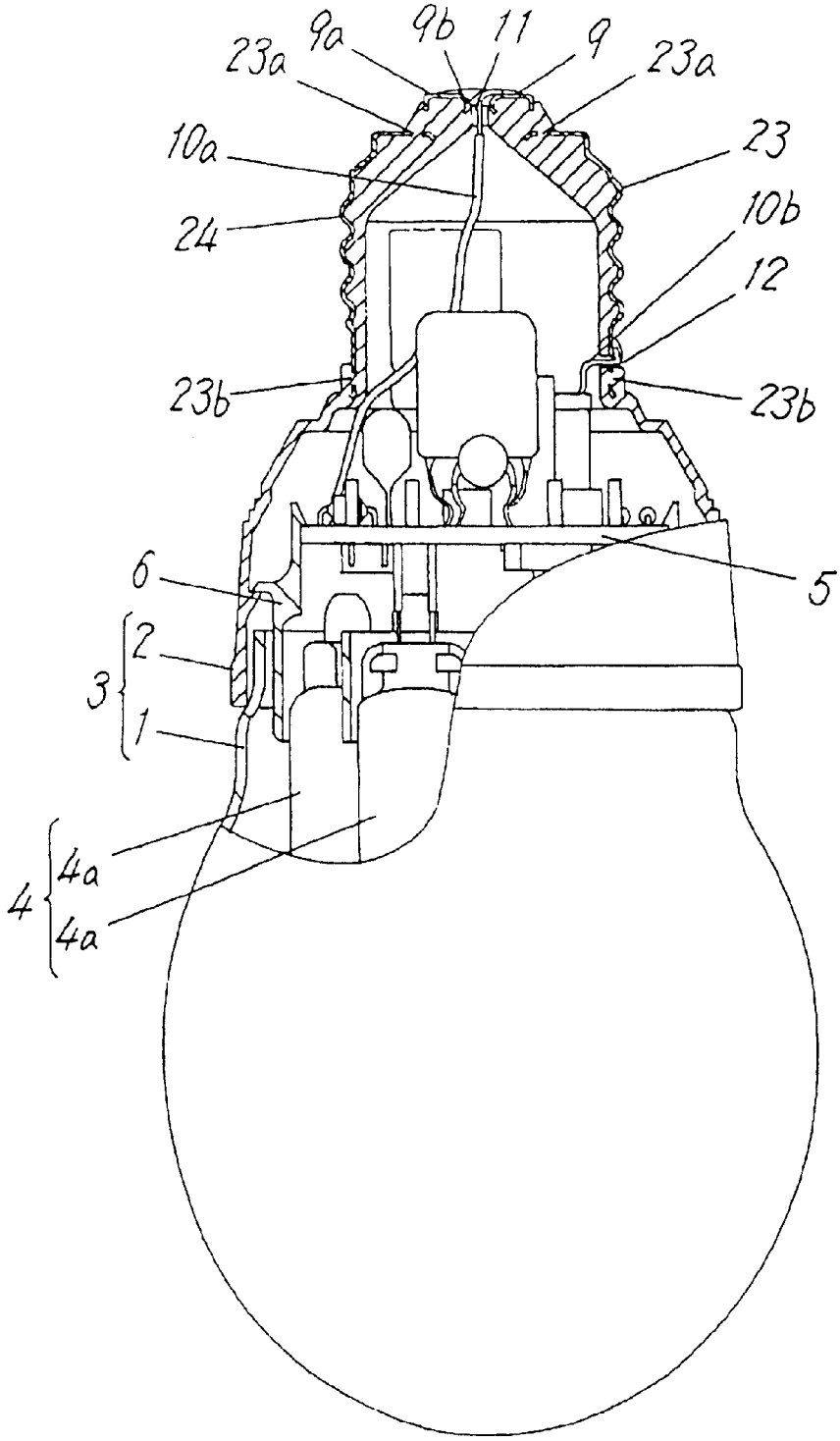
FIG. 9 is a partly fragmentary front view of a compact self-ballasted fluorescent lamp according to a second embodiment of the present invention.

Next, a compact self-ballasted fluorescent lamp with rated power of 13W according to a second embodiment of the present invention has the same configuration as that according to the first embodiment except difference in structure of a shell 23 as shown in FIG. 9.

The shell 23 has overall length of 23 mm, maximum outer diameter of 24 mm and thickness of 0.1 to 0.2 mm and is formed with screw threads at its side surface, molded integrally with the side surface of one end of the casing 2 to make contact with the outer surface of the casing 2 leaving substantially no gap.

The shell 23 is embedded at its both ends in the casing 2 in order to permit tight fixing of the shell 23 to the casing 2 and to thereby prevent the shell 23 from being off the casing 2.

In addition, each tip of both ends of the shell 23 is bent inwardly and outwardly from the shell 23, respectively, in order to permit further tight fixing of the shell 23 to the casing 2.

Furthermore, at both ends of the shell 23, a plurality of through holes 23*a* and 23*b* with diameter of 1 mm are provided, which are filled with part of the casing 2.

As described above, the shell 23 is molded integrally with one end of the casing 2 to make contact with the outer surface of the casing 2 leaving substantially no gap. According to this configuration including a few components and manufactured at low cost, for example, when fitted in the socket of the lighting equipment having the strip-shaped lamp holder, the shell 23 does not catch against the lamp holder so that it can be easily fitted in the socket and that the shell 23 can make contact with the lamp holder wherever it is in the socket, which means certain electrical contact can be obtained between the shell 23 and the socket. Besides, filling the through holes 23*a* and 23*b*, provided on the shell 23, with part of the casing 2, though it is an easy step, improves rotational strength of the shell 23 when the cap 24 is fitted in or removed from the socket of the lighting equipment, thereby preventing lost motion of the shell 23.

Figure 10:
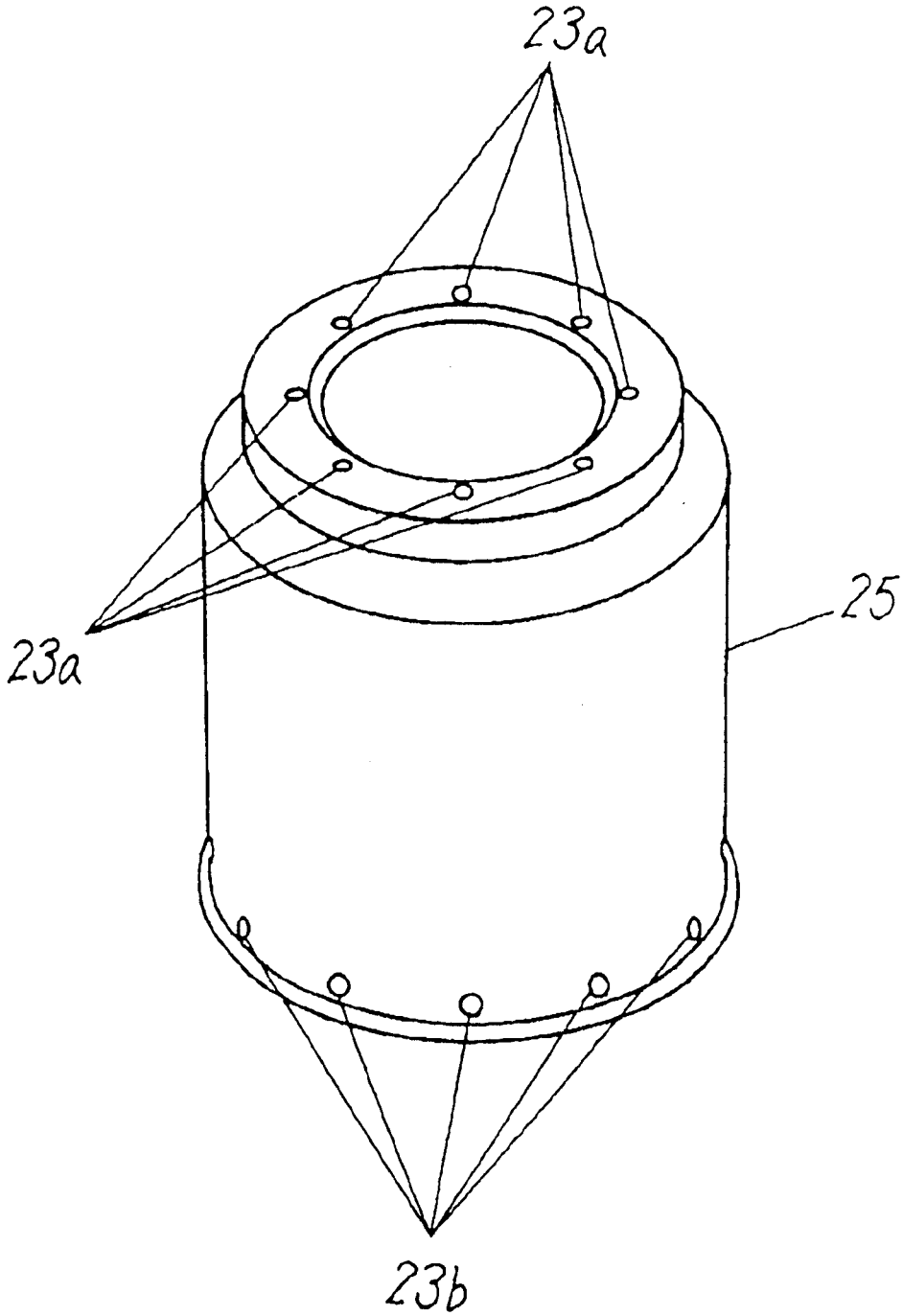
FIG. 10 is a sectional view of a shell member for forming a shell of the compact self-ballasted fluorescent lamp.

A blank member for forming the shell 23 (shell member 25) is as shown in FIG. 10.

In the above described second embodiment, description is made with respect to the case where the shell 23 is provided at its both ends with the through holes 23*a* and 23*b*. However, the above described effect can be obtained when the through hole 23*a* (the through hole 23*b*) is provided at the tip of at least one end of the shell 23.

Figure 11:
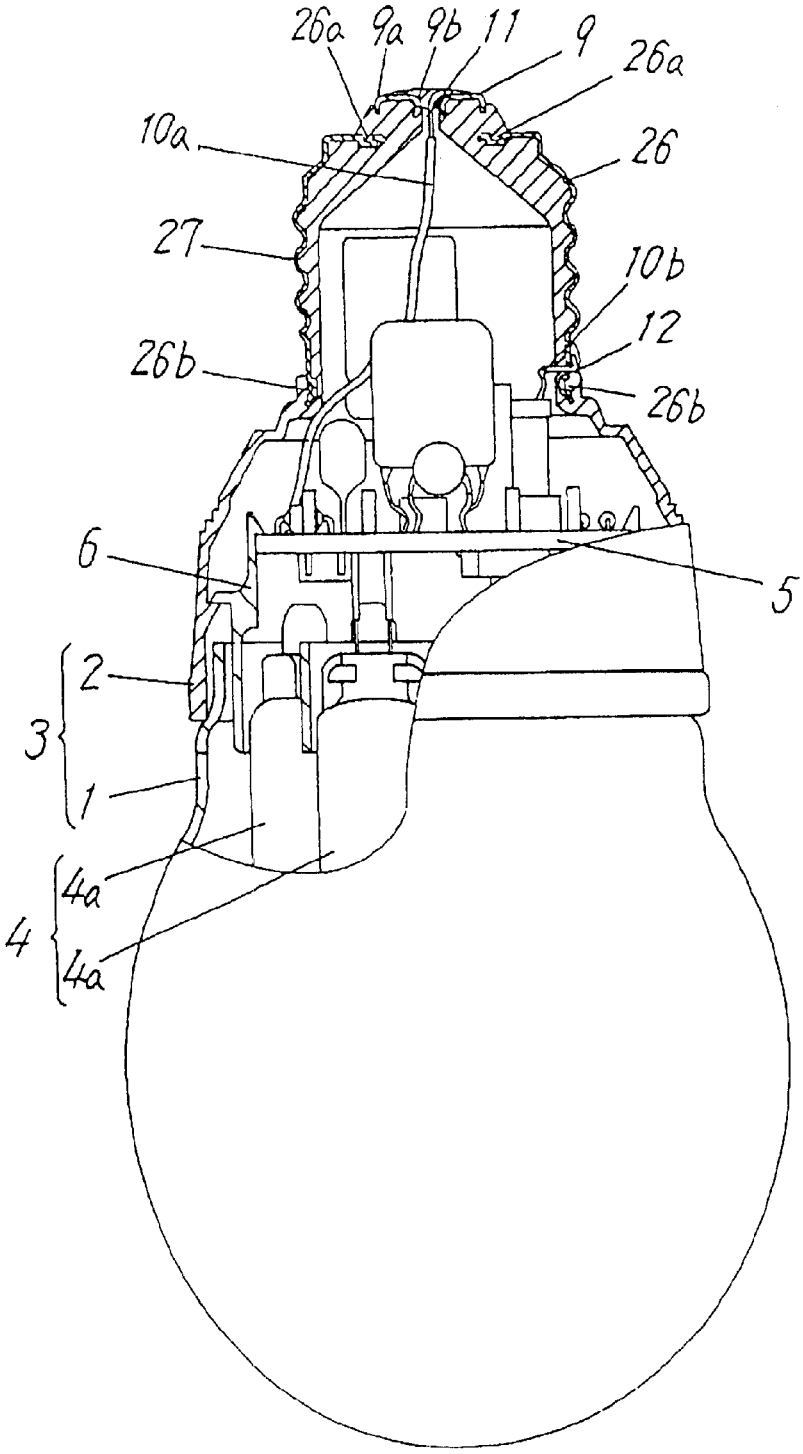
FIG. 11 is a partly fragmentary front view of a compact self-ballated fluorescent lamp according to a third embodiment of the present invention.
Figure 12:
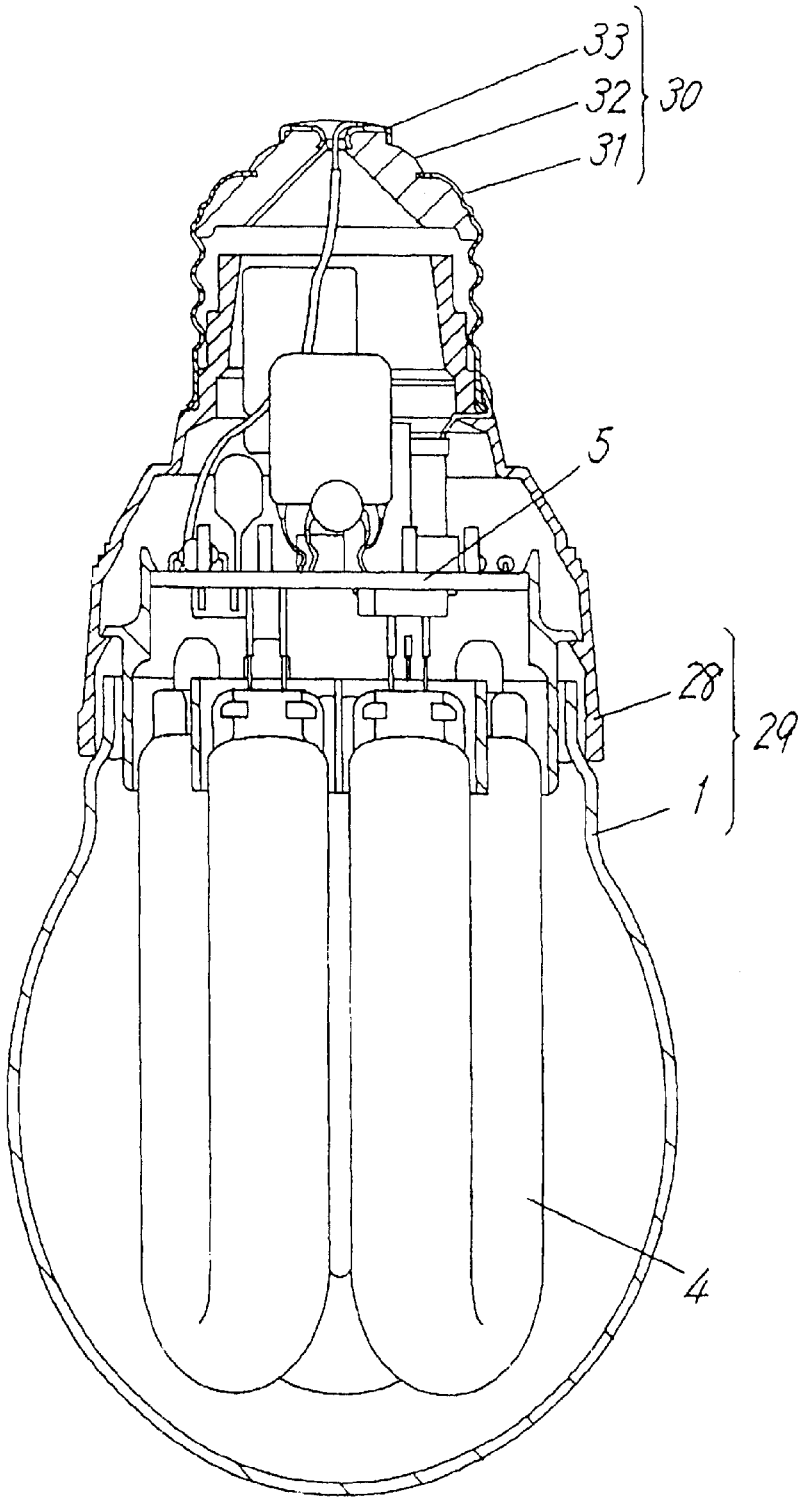
FIG.12 PRIOR ART
FIG. 12 is a partly fragmentary front view of a conventional compact self-ballasted fluorescent lamp.

Next, a compact self-ballasted fluorescent lamp with rated power of 13W according to a third embodiment of the present invention has the same configuration as that according to the first embodiment of the present invention except difference in structure of a shell 26 as shown in FIG. 11.

The shell 26 has overall length of 23 mm, maximum outer diameter of 24 mm and thickness of 0.1 to 0.2 mm and is formed with screw threads at its side surface, molded integrally with the side surface of one end of the casing 2 to make contact with the outer surface of the casing 2 leaving substantially no gap.

The shell 26 is embedded at its both ends in the casing 2 in order to permit tight fixing of the shell 26 to the casing 2 and to thereby prevent the shell 26 from being off the casing 2.

In addition, each tip of both ends of the shell 26 is bent inwardly and outwardly from the shell 26, respectively in order to permit further tight fixing of the shell 26 to the casing 2.

Furthermore, at both ends of the shell 26, a plurality of recesses 26*a* and 26*b* with length of 1 to 2 mm, width of 1 mm and depth of 0.5 mm are provided, which are filled with part of the casing 2.

As described above, the shell 26 is integrally molded with one end of the casings 2 to make contact with the outer surface of the casing 2 leaving substantially no gap. According to this configuration including a few components and manufactured at low cost, for example, when fitted in the socket of lighting equipment having a strip-shaped lamp holder, the shell 26 does not catch against the lamp holder that it can be easily fitted in the socket and that the shell 26 can make contact with the lamp holder wherever it is in the socket, which means that certain electrical contact can be obtained between the shell 26 and the socket. Besides, filling the recesses 26*a* and 26*b*, provided on the shell 26, with part of the casing 2, though it is an easy step, improves rotational strength of the shell 26 when the cap 27 is fitted in or removed from the socket of the lighting equipment, thereby preventing lost motion of the shell 26.

In the above described third embodiment, description is made with respect to the case where the shell 26 is provided at its both ends with the recesses 26*a* and 26*b*. However, the above described effect can be obtained when the recess 26*a* (the recess 26*b*) is provided at the tip of at least one end of the shell 26.

In the above described each embodiment, descriptions are made with respect to the case of the compact self-ballasted fluorescent lamp. However, the above described effect can be obtained with respect to bulb-form lamps such as an incandescent lamp, a reflector lamp, a high-pressure discharge lamp or the like.

Further, in the above described each embodiment, descriptions are made in respect of the case where, in the lamp fitted in the socket of the lighting equipment, the portion to be fitted in the socket, namely, the caps 7, 24 and 27 are formed with the screw threads at the side surfaces of the shell 8, 23 and 26. However, the above described effect can be obtained in case of using caps with no screw thread.

What is claimed is:

1. A lamp comprising:

a casing having two ends and extending from a glass globe at one end to an eyelet at the other end;

a shell surrounding a part of the casing having a portion for mounting an eyelet at one end thereof and a portion for mounting a holder at the other end thereof, wherein said shell is molded integrally with one end of said casing and is in contact with an outer surface of said casing leaving substantially no gap.

2. The lamp according to claim 1, wherein said shell further comprises screw threads at a side surface thereof.

3. The lamp according to claim 1, wherein at least one end of said shell is embedded in said casing.

4. The lamp according to claim 3, wherein a tip of an end of said shell is bent inwardly or outwardly from said shell.

5. The lamp according to claim 3, wherein a cut-out portion is located at a tip of an end of said shell embedded in said casing.

6. The lamp according to claim 1, wherein said shell further comprises a through hole filled with part of said casing.

7. The lamp according to claim 1, wherein said shell further comprises at least one end thereof with a recess filled with part of said casing.

8. The lamp according to claim 1, wherein said shell further comprises an eyelet molded integrally with a tip of said casing for contact with an outer surface of said casing, and no gap between said tip and said casing.

9. The lamp according to claim 1, wherein both ends of the shell are embedded in said casing.

* * * * *